US011527199B2

(12) United States Patent
Wang

(10) Patent No.: US 11,527,199 B2
(45) Date of Patent: Dec. 13, 2022

(54) PIXEL CIRCUIT INCLUDING DISCHARGE CONTROL CIRCUIT AND STORAGE CONTROL CIRCUIT AND METHOD FOR DRIVING PIXEL CIRCUIT, DISPLAY PANEL AND ELECTRONIC DEVICE

(71) Applicants: BEIJING BOE DISPLAY TECHNOLOGY CO., LTD., Beijing (CN); BOE TECHNOLOGY GROUP CO., LTD., Beijing (CN)

(72) Inventor: Zheng Wang, Beijing (CN)

(73) Assignees: BEIJING BOE DISPLAY TECHNOLOGY CO., LTD., Beijing (CN); BEIJING BOE TECHNOLOGY DEVELOPMENT CO., LTD., Beijing (CN)

( * ) Notice: Subject to any disclaimer, the term of this patent is extended or adjusted under 35 U.S.C. 154(b) by 665 days.

(21) Appl. No.: 16/337,042

(22) PCT Filed: Sep. 14, 2018

(86) PCT No.: PCT/CN2018/105748
§ 371 (c)(1),
(2) Date: Mar. 27, 2019

(87) PCT Pub. No.: WO2019/114348
PCT Pub. Date: Jun. 20, 2019

(65) Prior Publication Data

US 2021/0366385 A1 Nov. 25, 2021

(30) Foreign Application Priority Data

Dec. 13, 2017 (CN) ..... 201711332550.3

(51) Int. Cl.
*G09G 3/3233* (2016.01)
*G09G 3/3266* (2016.01)
*G09G 3/3291* (2016.01)

(52) U.S. Cl.
CPC ..... *G09G 3/3233* (2013.01); *G09G 3/3266* (2013.01); *G09G 3/3291* (2013.01); *G09G 2300/0866* (2013.01)

(58) Field of Classification Search
CPC ..... G09G 2300/0426; G09G 2300/043; G09G 2300/0819; G09G 2300/0861;
(Continued)

(56) References Cited

U.S. PATENT DOCUMENTS 8,325,118 B2 * 12/2012 Senda ..... G09G 3/3233 345/82
9,589,505 B2 3/2017 Zhang
(Continued)

FOREIGN PATENT DOCUMENTS

CN 101221725 A 7/2008
CN 102956201 3/2013
(Continued)

OTHER PUBLICATIONS

Extended European Search Report dated May 3, 2021 corresponding to European Patent Application No. 18857412.3; 13 pages.
(Continued)

*Primary Examiner* — Ram A Mistry
(74) *Attorney, Agent, or Firm* — Leason Ellis LLP

(57) ABSTRACT

A pixel circuit and a method for driving the pixel circuit, a display panel and an electronic device are provided. The pixel circuit includes a drive circuit, a storage circuit, a discharge control circuit, a storage control circuit, and a data writing circuit. The drive circuit is configured to control a driving current for driving a light-emitting element to emit
(Continued)

light; the storage circuit is connected to the control terminal of the drive circuit; the discharge control circuit is configured to control a voltage across the storage circuit and to control the second terminal of the drive circuit to discharge; the storage control circuit is configured to control the storage circuit to store a voltage of the drive circuit; the data writing circuit is configured to write a data voltage into the storage circuit to control the drive circuit.

20 Claims, 7 Drawing Sheets

(58) Field of Classification Search
CPC ... G09G 2310/0251; G09G 2320/0233; G09G 2320/045; G09G 2330/028; G09G 3/3225; G09G 3/3233; G09G 3/3283
See application file for complete search history.

(56) References Cited

U.S. PATENT DOCUMENTS

2004/0070557 A1 4/2004 Asano et al.
2006/0022605 A1* 2/2006 Ha ..... G09G 3/3233 315/169.3
2008/0036710 A1* 2/2008 Kim ..... G09G 3/3233 345/82
2008/0158205 A1 7/2008 Park et al.
2013/0194248 A1 8/2013 Kim
2014/0168180 A1 6/2014 Kim
2015/0348464 A1* 12/2015 In ..... G09G 3/2022 345/205
2016/0140894 A1* 5/2016 Eun ..... G09G 3/003 345/212
2016/0180772 A1 6/2016 Ma
2016/0275854 A1 9/2016 Wang et al.
2016/0372049 A1 12/2016 Wang et al.

FOREIGN PATENT DOCUMENTS

CN 103021333 A 4/2013
CN 103531151 1/2014
CN 103886838 A 6/2014
CN 104157240 A 11/2014
CN 104318894 1/2015
CN 104537983 A 4/2015
CN 106782339 A 5/2017
WO 2018166245 9/2018

OTHER PUBLICATIONS

Chinese Office Action dated Mar. 2, 2020 corresponding to Chinese Patent Application No. 201711332550.3; 20 pages.
International Search Report and Written Opinion in corresponding International Patent Application No. PCT/CN2018/105748 dated Dec. 19, 2018. 17 pages.

* cited by examiner

PIXEL CIRCUIT INCLUDING DISCHARGE CONTROL CIRCUIT AND STORAGE CONTROL CIRCUIT AND METHOD FOR DRIVING PIXEL CIRCUIT, DISPLAY PANEL AND ELECTRONIC DEVICE

This application is a U.S. National Stage Application under 35 U.S.C. § 371 of International Patent Application No. PCT/CN2018/105748, filed Sep. 14, 2018, which claims the benefit of priority to Chinese Patent Application No. 201711332550.3, filed on Dec. 13, 2017, both of which are incorporated by reference in their entireties as part of the present application.

The present application claims priority of the Chinese Patent Application No. 201711332550.3, filed on Dec. 13, 2017, the disclosure of which is incorporated herein by reference in its entirety as part of the present application.

TECHNICAL FIELD

Embodiments of the present disclosure relate to a pixel circuit and a method for driving the pixel circuit, a display panel and an electronic device.

BACKGROUND

Organic light emitting diode (OLED) display devices have attracted more and more attention gradually due to the advantages such as wide viewing angle, high contrast ratio, fast response speed, higher brightness and lower driving voltage than inorganic light-emitting display devices and the like. Due to the above characteristics, organic light emitting diodes (OLEDs) can be applied to devices, which have a display function, such as mobile phones, displays, notebook computers, digital cameras, instruments, meters and the like.

Pixel circuits in the OLED display devices generally adopt a matrix driving method, which is divided into an active matrix (AM) driving method and a passive matrix (PM) driving method according to whether or not a switching component is used in each pixel circuit. Although PMOLED has advantages such as simple process and low cost, it cannot meet the requirements of display with high resolution and large-size due to PMOLED's shortcomings such as crosstalk, high power consumption, short lifetime and the like. In contrast, AMOLED integrates a set of thin film transistors and storage capacitors in the pixel circuit of each pixel. By controlling the thin film transistors and the storage capacitors, it can be realized to control currents flowing through the OLED, so that the OLED can emit light as needed. Compared with PMOLED, AMOLED requires less driving current, lower power consumption and have longer lifetime, which can meet the needs of the large-size display with high resolution and multi-gradation. Also, AMOLED has obvious advantages in terms of viewing angle, color reduction, power consumption, response time and the like, and is suitable for display devices with high information content and high resolution.

SUMMARY

At least one embodiment of the present disclosure provides a pixel circuit, which includes a drive circuit, a storage circuit, a discharge control circuit, a storage control circuit, and a data writing circuit. The drive circuit comprises a control terminal, a first terminal and a second terminal, and is configured to control a driving current for driving a light-emitting element to emit light, and the first terminal of the drive circuit is configured to receive a first voltage from a first voltage terminal; the storage circuit is connected to the control terminal of the drive circuit; the discharge control circuit is connected to the storage circuit and the control terminal of the drive circuit, and is configured to control a voltage across the storage circuit and to control the second terminal of the drive circuit to discharge; the storage control circuit is connected to the control terminal of the drive circuit, the second terminal of the drive circuit, and the storage circuit, and is configured to control the storage circuit to store a voltage of the second terminal of the drive circuit; and the data writing circuit is connected to the storage circuit, a data signal input terminal, a first control signal terminal, and the discharge control circuit, and is configured to write a data voltage supplied from the data signal input terminal into the storage circuit to store the data voltage in the storage circuit in response to a first control signal input by the first control signal terminal, to control the drive circuit to be turned on to drive the light-emitting element to emit light.

For example, in the pixel circuit provided by an embodiment of the present disclosure, the drive circuit comprises a driving transistor; and a control electrode of the driving transistor is connected to the storage circuit, a first electrode of the driving transistor is connected to a first terminal of the light-emitting element, a second electrode of the driving transistor is connected to the first voltage terminal, and a second terminal of the light-emitting element is connected to a second voltage terminal to receive a second voltage.

For example, in the pixel circuit provided by an embodiment of the present disclosure, the data writing circuit comprises a first transistor; and a control electrode of the first transistor is connected to the first control signal terminal to receive the first control signal, a first electrode of the first transistor is connected to the storage circuit, and a second electrode of the first transistor is connected to the data signal input terminal to receive the data voltage.

For example, in the pixel circuit provided by an embodiment of the present disclosure, the storage circuit comprises a storage capacitor; and a first terminal of the storage capacitor is connected to the control electrode of the driving transistor, and a second terminal of the storage capacitor is connected to the first electrode of the first transistor.

For example, in the pixel circuit provided by an embodiment of the present disclosure, the storage control circuit comprises a second transistor; and a control electrode of the second transistor is connected to a second control signal terminal to receive a second control signal, a first electrode of the second transistor is connected to the first electrode of the driving transistor, and a second electrode of the second transistor is connected to the first terminal of the storage capacitor.

For example, in the pixel circuit provided by an embodiment of the present disclosure, the discharge control circuit comprises a third transistor and a fourth transistor; a control electrode of the third transistor is connected to a third control signal terminal to receive a third control signal, a first electrode of the third transistor is connected to the first voltage terminal or an initial voltage terminal, and a second electrode of the third transistor is connected to the second terminal of the storage capacitor; and a control electrode of the fourth transistor is connected to the third control signal terminal to receive the third control signal, a first electrode of the fourth transistor is connected to the first voltage terminal or the initial voltage terminal, and a second electrode of the fourth transistor is connected to the first terminal of the storage capacitor.

At least one embodiment of the present disclosure further provides a display panel, which includes a plurality of pixel units arranged in an array, and each of the plurality of pixel units includes the pixel circuit provided by any one of the embodiments of the present disclosure and a light-emitting element.

For example, the display panel provided by an embodiment of the present disclosure further includes a plurality of scan lines. The plurality of pixel units are arranged in a plurality of rows, a first control signal terminal of a data writing circuit of a pixel circuit of a pixel unit in an nth row is connected to a scan line in the nth row, a storage control circuit of the pixel circuit of the pixel unit in the nth row is connected to a scan line in an (n−1)th row, and a discharge control circuit of the pixel circuit of the pixel unit in the nth row is connected to a scan line in an (n−2)th row; the scan line in the (n−1)th row is further connected to a first control signal terminal of a data writing circuit of a pixel circuit of a pixel unit in the (n−1)th row; the scan line in the (n−2)th row is further connected to a first control signal terminal of a data writing circuit of a pixel circuit of a pixel unit in the (n−2)th row; and n is an integer greater than 3.

For example, in the display panel provided by an embodiment of the present disclosure, the light-emitting element is an organic light-emitting diode.

For example, the display panel provided by an embodiment of the present disclosure further includes a voltage generating circuit. The voltage generating circuit is connected to the first voltage terminal and/or a second voltage terminal, and is configured to correspondingly change a value of the first voltage provided by the first voltage terminal and/or a value of a second voltage provided by the second voltage terminal.

At least one embodiment of the present disclosure further provides an electronic device, which includes the display panel provided by any one of the embodiments of the present disclosure.

At least one embodiment of the present disclosure further provides a method for driving the pixel circuit, which includes: controlling, by the discharge control circuit, the second terminal of the drive circuit to discharge, to enable a voltage of the second terminal of the drive circuit to being based on a threshold voltage of the drive circuit; controlling, by the storage control circuit, the storage circuit to store the threshold voltage; and writing the data voltage into the storage circuit through the data writing circuit, and controlling the drive circuit to be turned on to drive the light-emitting element to emit light based on the data voltage and the threshold voltage stored in the storage circuit.

For example, in the method for driving the pixel circuit provided by an embodiment of the present disclosure, each light-emitting period of the light-emitting element comprises three phases, and the method further includes: in a first phase, controlling the discharge control circuit to be turned on, and controlling the second terminal of the drive circuit to discharge to the first voltage terminal until the voltage of the second terminal of the drive circuit reaches the threshold voltage; in a second phase, controlling the storage control circuit to be turned on, and storing the threshold voltage in the storage circuit; and in a third phase, inputting, through the first control signal terminal, the first control signal to control the data writing circuit to be turned on, a voltage of a first terminal of a storage capacitor coupling as a sum of the data voltage and the threshold voltage, to turn on the drive circuit to drive the light-emitting element to emit light.

For example, the method for driving the pixel circuit provided by an embodiment of the present disclosure further includes: in the first phase, changing the first voltage to control the second terminal of the drive circuit to discharge to the first voltage terminal; and in the third phase, changing the first voltage again to enable the drive circuit to be turned on to drive the light-emitting element to emit light.

For example, in the method for driving the pixel circuit provided by an embodiment of the present disclosure, a second terminal of the light-emitting element is connected to a second voltage terminal to receive a second voltage, and the method further includes: in the first phase, changing the first voltage and the second voltage to control the second terminal of the drive circuit to discharge to the first voltage terminal; and in the third phase, changing the first voltage and the second voltage again to enable the drive circuit to be turned on to drive the light-emitting element to emit light.

BRIEF DESCRIPTION OF THE DRAWINGS

In order to clearly illustrate the technical solutions of the embodiments of the disclosure, the drawings of the embodiments will be briefly described in the following; it is obvious that the described drawings are only related to some embodiments of the disclosure and thus are not limitative to the disclosure.

DETAILED DESCRIPTION

Figure 1A:
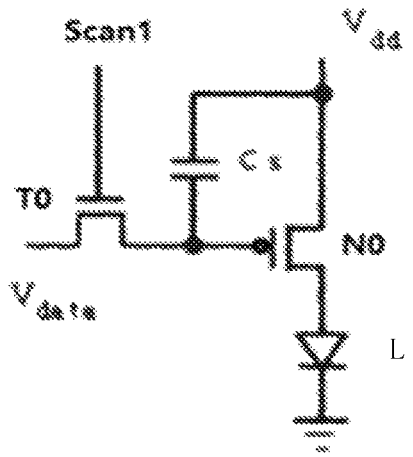
FIG. 1A is a schematic diagram of a pixel circuit with 2T1C.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intterminaled to indicate any sequence, amount or importance, but distinguish various components. The terms "comprise," "comprising," "include," "including," etc., are intterminaled to specify that the elements or the objects stated before these terms encompass the elements or the objects and equivalents thereof listed after these terms, but do not preclude the other elements or objects. The phrases "connect", "connected", etc., are not intterminaled to define a physical connection or mechanical connection, but may include an electrical connection, directly or indirectly.

Embodiments of the present disclosure are described in detail below, examples of the embodiments are illustrated in the drawings, and the same or similar reference numerals indicate the same or similar elements or elements having the same or similar functions. The embodiments described below with reference to the accompanying drawings are exemplary. The embodiments are intended to explain the present disclosure, and are not to be construed as limitation of the embodiments of the present disclosure.

Figure 1B:
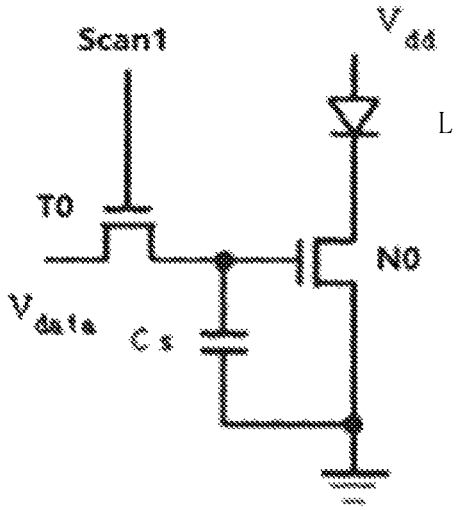
FIG. 1B is a schematic diagram of another pixel circuit with 2T1C.

In OLED display panels, because OLEDs of sub-pixels are driven by currents to emit light, the stability of the currents of the OLEDs is very important, and directly affects display brightness of the OLEDs. A driving current of an OLED is generally related to a threshold voltage of a driving TFT (Thin Film Transistor), and a TFT fabricated by an a-Si (Amorphous Silicon) process has a problem of threshold voltage drift. That is, when a voltage is applied to a gate electrode and a source electrode of the TFT, the threshold voltage of the TFT is gradually increased, and a current flowing through the TFT is gradually attenuated, which directly affects the brightness and lifetime of the OLED connected to the TFT. FIG. 1A and FIG. 1B are two schematic diagrams of pixel circuits with 2T1C, respectively.

As shown in FIG. 1A, a pixel circuit with 2T1C includes a switching transistor T0, a driving transistor N0, and a storage capacitor Cs. For example, a gate electrode of the switching transistor T0 is connected to a scan line to receive a scan signal Scan1, for example, a source electrode of the switching transistor T0 is connected to a data line to receive a data signal Vdata, and a drain electrode of the switching transistor T0 is connected to a gate electrode of the driving transistor N0; a source electrode of the driving transistor N0 is connected to a first voltage terminal to receive a first voltage Vdd (high voltage), and a drain electrode of the driving transistor N0 is connected to an anode of a light-emitting element (here, the light-emitting element is an OLED); one terminal of the storage capacitor Cs is connected to the drain electrode of the switching transistor T0 and the gate electrode of the driving transistor N0, and another terminal of the storage capacitor Cs is connected to the source electrode of the driving transistor N0 and the first voltage terminal; and a cathode of the OLED is connected to a second voltage terminal to receive a second voltage Vss (low voltage, such as a grounded voltage). The pixel circuit with 2T1C is driven by controlling the two TFTs and the storage capacitor Cs to control the brightness and darkness (gray scale) of the pixel. When the scan signal Scan1 is applied through the scan line to turn on the switching transistor T0, the data signal Vdata written by a data driving circuit through the data line charges the storage capacitor Cs via the switching transistor T0, thereby the data signal Vdata is stored in the storage capacitor Cs, and the data signal Vdata stored in the storage capacitor Cs controls the conduction degree of the driving transistor N0, thereby controlling a value of the current flowing through the driving transistor to drive the OLED to emit light, i.e., the current determines the gray scale of the illumination of the pixel. In the pixel circuit with 2T1C as shown in FIG. 1A, the switching transistor T0 is an N-type transistor and the driving transistor N0 is a P-type transistor.

As shown in FIG. 1B, another pixel circuit with 2T1C also includes a switching transistor T0, a driving transistor N0, and a storage capacitor Cs, but the connection mode as shown in FIG. 1B is slightly changed compared with the connection mode as shown in FIG. 1A, and the driving transistor N0 is an N-type transistor. Differences of the pixel circuit as shown in FIG. 1B compared to the pixel circuit as shown in FIG. 1A includes that: the anode of the OLED is connected to the first voltage terminal to receive the first voltage Vdd (high voltage), the cathode of the OLED is connected to the drain electrode of the driving transistor N0, and the source electrode of the driving transistor N0 is connected to the second voltage terminal to receive the second voltage Vss (low voltage, for example, a grounded voltage). One terminal of the storage capacitor Cs is connected to the drain electrode of the switching transistor T0 and the gate electrode of the driving transistor N0, and the other terminal of the storage capacitor Cs is connected to the source electrode of the driving transistor N0 and the second voltage terminal. The operation mode of the pixel circuit with 2T1C is basically the same as the operation mode of the pixel circuit as shown in FIG. 1A, and details are not described here again.

In addition, for the pixel circuits as shown in FIGS. 1A and 1B, the switching transistor T0 is not limited to the N-type transistor, and may be a P-type transistor as needed, thereby an polarity of the scan signal Scan1 that controls the switching transistor T0 to be turned on or turned off may be changed accordingly.

In the pixel circuit as shown in FIGS. 1A and 1B, the driving transistor N0 has a large duty ratio, which may aggravate the drift of the threshold voltage of the driving transistor N0, so that the current flowing through the driving transistor N0 gradually becomes lower, affecting the display brightness of the OLED.

An embodiment of the present disclosure provides a pixel circuit, which includes a drive circuit, a storage circuit, a discharge control circuit, a storage control circuit, and a data writing circuit. The drive circuit includes a control terminal, a first terminal and a second terminal, and is configured to control a driving current for driving a light-emitting element to emit light, and the first terminal of the drive circuit is configured to receive a first voltage from a first voltage terminal; the storage circuit is connected to the control terminal of the drive circuit; the discharge control circuit is connected to the storage circuit and the control terminal of the drive circuit, and is configured to control a voltage across the storage circuit and to control the second terminal of the drive circuit to discharge; the storage control circuit is connected to the control terminal of the drive circuit, the second terminal of the drive circuit, and the storage circuit, and is configured to control the storage circuit to store a voltage of the second terminal of the drive circuit; and the data writing circuit is connected to the storage circuit, a data signal input terminal, a first control signal terminal, and the discharge control circuit, and is configured to write a data voltage supplied from the data signal input terminal into the storage circuit to store the data voltage in the storage circuit in response to a first control signal input by the first control signal terminal, to control the drive circuit to be turned on to drive the light-emitting element to emit light. At least one embodiment of the present disclosure also provides a method, a display panel, and an electronic device corresponding to the above pixel circuit.

The pixel circuit provided by the above embodiment of the present disclosure can eliminate the influence of the threshold voltage of the drive circuit in the pixel circuit on the driving current, thereby improving the display effect of the light-emitting element and prolonging the service life of the light-emitting element.

The pixel circuit, the method for driving the pixel circuit, the display panel, and the electronic device of the embodiments of the present disclosure are described below with reference to the accompanying drawings. It should be noted that like reference numerals will be used in the different drawings to refer to the like elements that have been described.

Embodiments of the present disclosure provide a pixel circuit 100 that is used to, for example, drive a light-emitting element in a sub-pixel of a display panel to emit light. In at least one embodiment of the present disclosure, for example, the display panel is manufactured with a glass substrate. Specific structures and manufacturing processes may adopt conventional methods in the art, which are not described in detail here, and the embodiments of the present disclosure are not limited to this case. For example, the light-emitting element may be an OLED, a QLED (Quantum Dot Light Emitting Diode) or the like, and the corresponding display panel may be an OLED display panel, a QLED display panel or the like. In the following, the OLED is taken as an example for description, and corresponding descriptions is also applicable to the QLED.

Figure 2A:
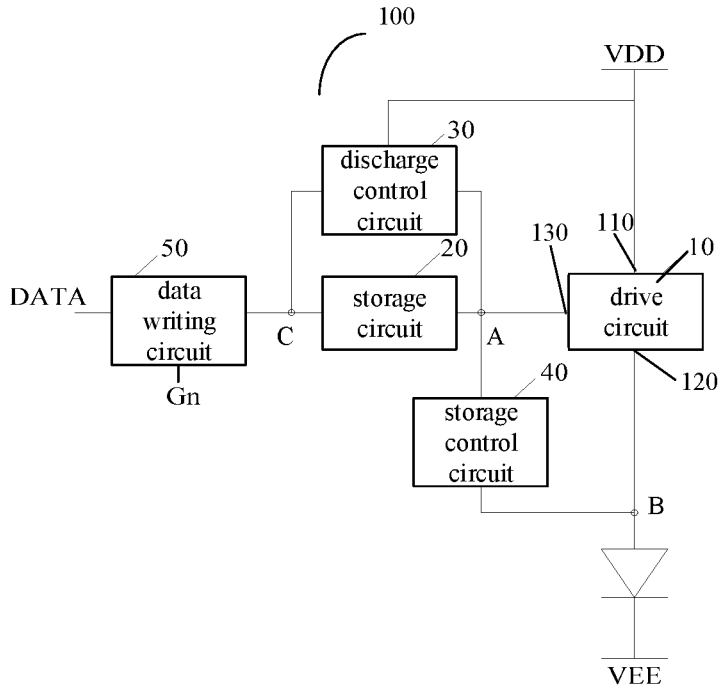
FIG. 2A is a structural schematic diagram of a pixel circuit according to an embodiment of the present disclosure.

FIG. 2A is a structural schematic diagram of a pixel circuit according to an embodiment of the present disclosure. As shown in FIG. 2A, the pixel circuit 100 provided by the embodiment of the present disclosure includes a drive circuit 10, a storage circuit 20, a discharge control circuit 30, a storage control circuit 40, and a data writing circuit 50.

For example, the drive circuit 10 includes a control terminal 130 (a first node A), a first terminal 110 and a second terminal 120 (a second node B). For example, the drive circuit 10 is connected to a light-emitting element (here, the light-emitting element is an OLED) and a first voltage terminal VDD, and is configured to control a driving current for driving the light-emitting element to emit light. The first terminal 110 of the drive circuit 10 is configured to receive a first voltage from the first voltage terminal VDD. For example, in a light-emitting phase, the drive circuit 100 may supply a driving current to the light-emitting element to drive the light-emitting element to emit light, and enable the light-emitting element to emit light according to a desired "grayscale".

The storage circuit 20 is connected to the control terminal 130 (the first node A) of the drive circuit 10, and is configured to store a data voltage written by the data writing circuit 50 and/or a threshold voltage. For example, the storage circuit 20 can store the data voltage and/or the threshold voltage, and control the drive circuit 10 by the data voltage and/or the threshold voltage stored in the storage circuit 20. For example, in a case where the storage circuit 20 includes a storage capacitor, the storage circuit 20 can store the data voltage written by the data writing circuit 50 and the threshold voltage into the storage capacitor, so the drive circuit 10 can be controlled by the stored data voltage and/or threshold voltage during, for example, the light-emitting phase.

The discharge control circuit 30 is connected to the storage circuit 20 (a third node C) and the control terminal 130 (the first node A) of the drive circuit 10, and is configured to control a voltage across the storage circuit 20 and to control the second terminal of the drive circuit 10 to discharge. For example, in an example as shown in FIG. 2A, the discharge control circuit 30 is further connected to the first voltage terminal VDD and a third control signal terminal (not shown in FIG. 2A), and is configured to connect the first node A and the third node C with the first voltage terminal VDD (for example, the first voltage with a low level (e.g., 0V (volts) or a grounded voltage) is provided by the first voltage terminal VDD at this time) in response to a third control signal provided by the third control signal terminal, so that the second terminal 120 (e.g., a high level during the last light-emitting period) of the drive circuit discharges to the first voltage terminal VDD. For example, in a case where the drive circuit 10 is implemented as a driving transistor, the driving transistor is turned off when a voltage of the second node B is discharged equal to the threshold voltage of the driving transistor.

The storage control circuit 40 is connected to the control terminal 130 (the first node A) of the drive circuit 10, the second terminal 120 (the second node B) of the drive circuit 10, and the storage circuit 20, and is configured to control the storage circuit 20 to store a voltage after the drive circuit 10 discharges. For example, the storage control circuit 40 is further connected to a second control signal terminal (not shown in FIG. 2A), and is configured to be turned on under the control of a second control signal provided by the second control signal terminal to store the voltage (i.e., a voltage of the second node B) after the drive circuit 10 discharges into the storage circuit 20.

The data writing circuit 50 is connected to the storage circuit 20, a data signal input terminal DATA, a first control signal terminal Gn, and the discharge control circuit 30, and is configured to write a data voltage Vdata (not shown in FIG. 2A) into the storage circuit 20 to store the data voltage in the storage circuit 20 under the control of a first control signal input by the first control signal terminal Gn, to control the drive circuit 10 to be turned on to drive the light-emitting element to emit light. For example, the data writing circuit 50 can be turned on in response to the first control signal provided by the first control signal terminal Gn, so the data voltage can be written to the control terminal 130 (the first node A) of the drive circuit 10, and can be stored in the above-described storage circuit 20, and therefore a driving current for driving the light-emitting element to emit light can be generated based on the data voltage Vdata. For example, the value of the data voltage Vdata determines the luminance (i.e., a gray level used for display) of the pixel unit.

Figure 2B:
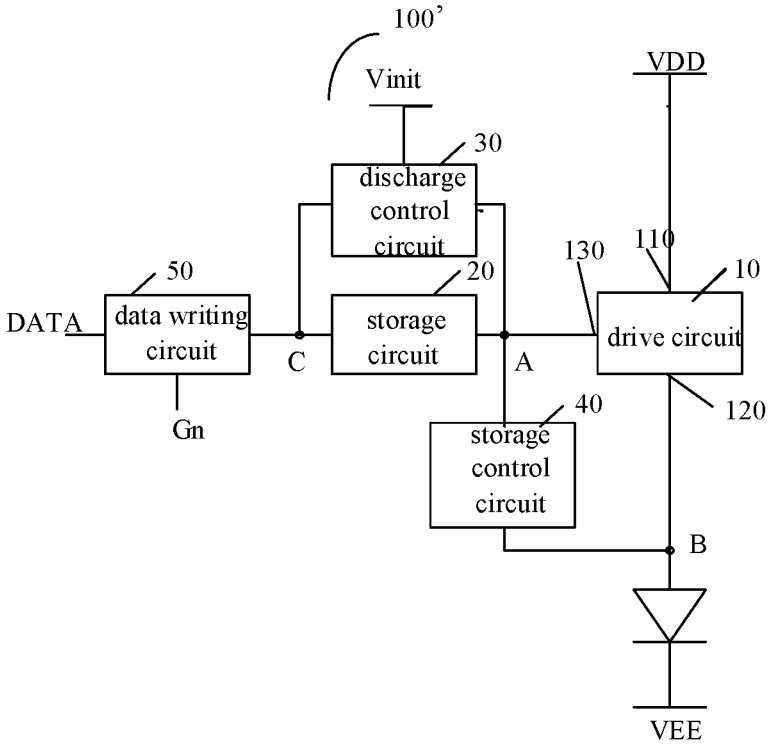
FIG. 2B is a structural schematic diagram of another pixel circuit according to an embodiment of the present disclosure.

For example, in an example as shown in FIG. 2B, a pixel circuit 100' is also provided. The structure of the pixel circuit 100' is similar to the structure of the pixel circuit 100 as shown in FIG. 2A, and will not be described here. The difference between the structure of the pixel circuit 100' and the structure of the pixel circuit 100 as shown in FIG. 2A includes that: the discharge control circuit 30 included in the pixel circuit 100' may also be connected to an initial voltage terminal Vinit and a third control signal terminal (not shown in FIG. 2B), and is configured to connect the first node A and the third node C with the initial voltage terminal Vinit (for example, providing an initial voltage with low level (for example, 0V or a grounded voltage) in response to a third control signal provided by the third control signal terminal, thereby enabling the second terminal 120 (for example, at a high level during the previous light-emitting period) of the drive circuit to discharge to the initial voltage terminal Vinit.

It should be noted that, in the description of the embodiments of the present disclosure, the first node A, the second node B, and the third node C do not represent the actually existing components, but represent the convergence points of the connections of related circuits in the circuit diagram for ease of description.

The pixel circuit provided by the above embodiments of the present disclosure can eliminate the influence of the drift of the threshold voltage of the drive circuit in the pixel circuit on the driving current of the light-emitting element, thereby improving the display effect of the light-emitting element and prolonging the service life of the light-emitting element.

Figure 3A:
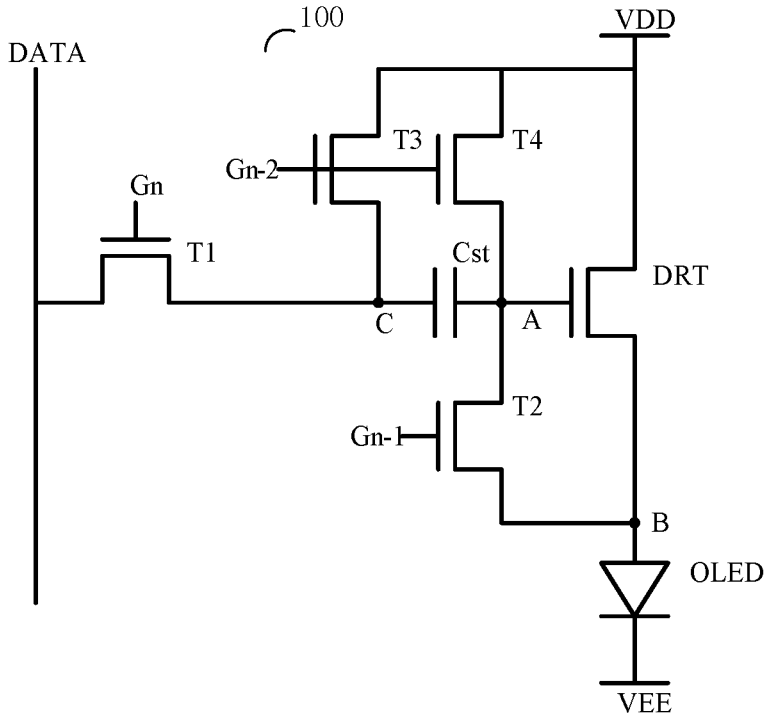
FIG. 3A is a circuit diagram showing a specific implementation example of the pixel circuit as shown in FIG. 2A.

An example of the pixel circuit 100 as shown in FIG. 2A may be implemented as a structure of pixel circuit as shown in FIG. 3A. As shown in FIG. 3A, the pixel circuit 100 includes a driving transistor DRT and first to fourth transistors T1, T2, T3 and T4, and further includes a storage capacitor Cst and a light-emitting element (i.e., an OLED). For example, the first to fourth transistors T1, T2, T3 and T4 are used as switching transistors. For example, the light-emitting element may be of various types, such as top emission, bottom emission, etc., and may emit red, green, blue or white light, etc., which is not limited to this case in the embodiments of the present disclosure. For example, in the embodiment of the present disclosure, each switching transistor may employ an N-type transistor, and the driving transistor DRT may employ a P-type transistor. For example, the N-type transistor is turned on in response to a high level signal and is turned off in response to a low level signal, and the P-type transistor is turned on in response to a low level signal and is turned off in response to a high level signal. The following embodiments are the same as this, and are not described again.

In an embodiment of the present disclosure, as shown in FIG. 3A, the drive circuit 10 includes a driving transistor DRT. A control electrode (i.e., a gate electrode) of the driving transistor DRT serving as the control terminal 130 of the drive circuit 10 is connected to the storage circuit 10, a first electrode of the driving transistor DRT serving as the second terminal 120 of the drive circuit 10 is connected to a first terminal of the light-emitting element, and a second electrode of the driving transistor DRT serving as the first terminal 110 of the drive circuit 10 is connected to the first voltage terminal VDD. A second terminal of the light-emitting element is connected to a second voltage terminal VEE to receive a second voltage.

The data writing circuit 50 includes a first transistor T1. A control electrode of the first transistor T1 is connected to the first control signal terminal Gn to receive the first control signal, a first electrode of the first transistor T1 is connected to the storage circuit 20 (the third node C), and a second electrode of the first transistor T1 is connected to the data signal input terminal DATA to receive the data voltage.

The storage circuit 20 includes a storage capacitor Cst. A first terminal of the storage capacitor Cst is connected to the control electrode (the first node A) of the driving transistor T1, and a second terminal of the storage capacitor Cst is connected to the first electrode (the third node C) of the first transistor T1.

The storage control circuit 40 includes a second transistor T2. A control electrode of the second transistor T2 is connected to a second control signal terminal Gn-1 to receive a second control signal, a first electrode of the second transistor T2 is connected to the first electrode (the second node B) of the driving transistor DRT, and a second electrode of the second transistor T2 is connected to the first terminal of the storage capacitor Cst.

The discharge control circuit 30 includes a third transistor T3 and a fourth transistor T4. A control electrode of the third transistor T3 is connected to a third control signal terminal Gn-2 to receive a third control signal, a first electrode of the third transistor T3 is connected to the first voltage terminal VDD, and a second electrode of the third transistor T3 is connected to the second terminal of the storage capacitor Cst. A control electrode of the fourth transistor T4 is connected to the third control signal terminal Gn-2 to receive the third control signal, a first electrode of the fourth transistor T4 is connected to the first voltage terminal VDD, and a second electrode of the fourth transistor T4 is connected to the first terminal of the storage capacitor Cst. In the present embodiment, T1, T2, T3 and T4 are all N-type transistors.

In the pixel circuit of the embodiments of the present disclosure, each light-emitting period of the light-emitting element includes three phases.

In a first phase, the first voltage terminal VDD provides the first voltage Vdd, the first voltage Vdd is at a low level (For example, the low level is 0V or a grounded voltage), the third control signal terminal Gn-2 inputs the third control signal to control the third transistor T3 and the fourth transistor T4 to be turned on, to control the first electrode of the driving transistor DRT to discharge to the first voltage terminal VDD until the voltage of the first electrode of the driving transistor DRT reaches the threshold voltage Vth.

In a second phase, the second control signal terminal Gn-1 inputs the second control signal to control the second transistor T2 to be turned on, to store the threshold voltage Vth in the storage capacitor Cst.

In a third phase, the first control signal terminal Gn inputs the first control signal to control the first transistor T1 to be turned on, and a voltage of the first terminal of the storage capacitor Cst is coupled to a sum of the data voltage and the threshold voltage, i.e., Vdata+Vth, to turn on the driving transistor DRT, to drive the light-emitting element to start to emit light.

For example, in a case where the first voltage supplied by the first voltage terminal VDD (i.e., the voltage of the gate electrode of the driving transistor DRT) becomes 0, the voltage of the first electrode of the driving transistor DRT reaches the threshold voltage Vth, and the data voltage input by the data signal input terminal is Vdata; and for example, in a case where the first voltage Vdd supplied by the first voltage terminal VDD is not 0 (for example, δ), the voltage of the first electrode of the driving transistor DRT reaches the threshold voltage Vth+δ (i.e., the voltage difference between the first electrode and the gate electrode of the driving transistor DRT is equal to the threshold voltage Vth), and the data voltage input by the data signal input terminal is Vdata−δ at this time, so that the voltage of the gate electrode of the driving transistor can be ensured to be Vdata+Vth. It should be noted that the following embodiments are the same as the above description, and are not described again.

For example, in the first phase and the second phase, the first voltage provided by the first voltage terminal VDD and the second voltage provided by the second voltage terminal VEE are changed, to enable that the control terminal of the drive circuit can discharge to the first voltage terminal VDD (for example, in a case where the driving transistor is implemented as an N-type transistor, the discharge process becomes charge process). For example, in the first phase, the first voltage is changed from a high level to a low level, and the second voltage is changed from a low level to a high level; in the second phase, the first voltage is kept at a low level, and the second level is kept at a high level; and in the third phase, the first voltage is changed from the low level in the second phase to a high level, and the second voltage is changed from the high level in the second phase to a low level.

It should be noted that the transistors used in the embodiments of the present disclosure may be thin film transistors, field effect transistors or other switching devices having the like characteristics. The thin film transistors are taken as an example for description in the examples of the embodiments of the present disclosure. The source electrode and the drain electrode of a transistor used here may be symmetrical in structure, so the source electrode and the drain electrode of the transistor may be indistinguishable in structure. In the embodiments of the present disclosure, in order to distinguish two electrodes of the transistor except the gate electrode, one of the two electrodes is described as a first electrode directly, and the other electrode is described as a second electrode.

Figure 4:
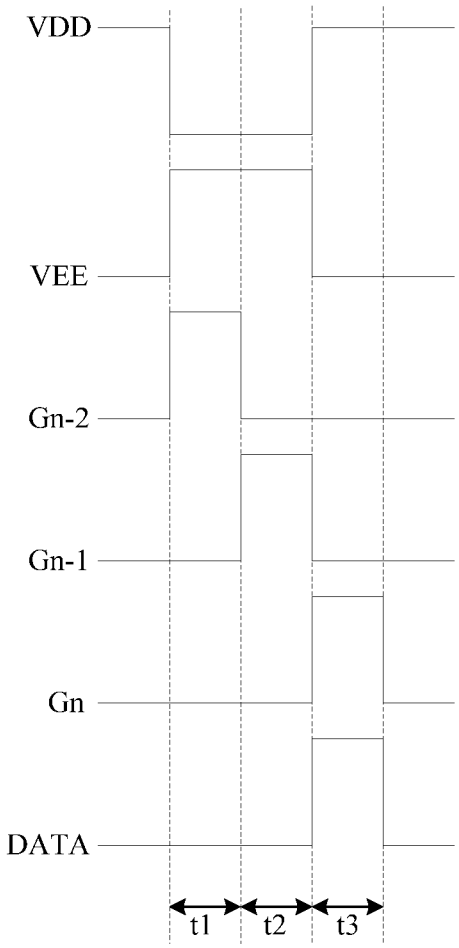
FIG. 4 is a timing diagram of signals of a pixel circuit according to an embodiment of the present disclosure.

Based on the above circuit structure, a signal timing as shown in FIG. 4 can be respectively provided by the first voltage terminal VDD, the second voltage terminal VEE, the first control signal terminal Gn, the second control signal terminal Gn-1, the third control signal terminal Gn-2, and the data signal input terminal DATA, to control the light-emitting elements to emit light.

For example, in conjunction with FIG. 3A and FIG. 4, in the first phase, that is, in a period t1, the third control signal terminal Gn-2 inputs a high level signal, the third transistor T3 and the fourth transistor T4 are turned on, the first voltage Vdd input by the first voltage terminal VDD changes from a high level to a low level (for example, the low level is 0V or a grounded level), the second voltage input by the second voltage terminal VEE changes from a low level to a high level, the first node A and the third node C are connected to the first voltage terminal VDD to become a low level, and the second electrode (for example, the drain electrode) of the driving transistor DRT is connected to the gate electrode, and the driving transistor DRT becomes a diode structure. Because the first electrode (for example, the source electrode) of the driving transistor DRT is at a high level during the previous light-emitting period, the first electrode of the driving transistor DRT discharges to the first voltage terminal VDD until the voltage difference between the first electrode and the gate electrode of the driving transistor DRT reaches the threshold voltage Vth, and for example, in a case where the first voltage supplied by the first voltage terminal VDD is 0V, the voltage of the second node B reaches the threshold voltage Vth.

In the second phase, that is, in a period t2, the second control signal terminal Gn-1 inputs a high level signal, the second transistor T2 is turned on, to enable the second node B to be electrically connected to the first node A, and the voltage of the second node B, that is, the threshold voltage Vth, is stored into the first terminal of the storage capacitor Cst, that is, the first node A.

In the third phase, that is, in a period t3, the first control signal terminal Gn inputs a high level signal, and the first transistor T1 is turned on, the first voltage input by the first voltage terminal VDD changes from a low level to a high level, and the second voltage input by the second voltage terminal VEE changes from a high level to a low level. The second terminal of the storage capacitor Cst is written with the data voltage Vdata, and the first terminal of the storage capacitor Cst is coupled to the sum of the data voltage and the threshold voltage, i.e., Vdata+Vth, that is, the voltage of the first node A is Vdata+Vth, to turn on the driving transistor DRT, to drive the light-emitting element to start to emit light. During this phase, the first voltage charges the second node B through the driving transistor DRT, and the voltage of the second node B is charged to the first voltage Vdd.

Specifically, the value of the driving current $I_{OLED}$ flowing through the light emitting-element can be obtained according to the following formula:

$$I_{OLED}=\tfrac{1}{2}*K(Vgs-Vth)\hat{}2$$

where K is a constant, and Vgs is the voltage between the gate electrode and the source electrode of the driving transistor DRT, that is, the voltage between the first node A and the second node B.

When the voltage of the first terminal of the storage capacitor Cst is Vdata+Vth, that is, the voltage of the gate electrode (the first node A) of the driving transistor DRT is Vdata+Vth, the driving transistor DRT is turned on, and the Vgs is substituted into the above formula to obtain Vgs−Vth as following:

$$Vgs-Vth=V\text{data}+Vth-Vdd-Vth=V\text{data}-Vdd$$

It can be seen that when the light-emitting element emits light, the current I is related to the data voltage Vdata and the first voltage Vdd, and is no longer related to the threshold voltage Vth of the driving transistor DRT, so that the influence of the threshold voltage of the driving transistor on the driving current of the light-emitting element can be eliminated, the display effect of the light-emitting element can be improved, and the service life of the light-emitting element can be prolonged.

The pixel circuit provided by the embodiments of the present disclosure can control the second terminal of the drive circuit 10 to discharge through the discharge control circuit 30 connected to the storage circuit 20 by providing the storage circuit 20 connected to the drive circuit 10, and can control the storage circuit 20 to store the voltage after the drive circuit 10 discharges by the storage control circuit 40, and the drive circuit 10 can be turned on by the data voltage and the voltage stored in the storage circuit 20 when the data writing circuit 50 writes the data voltage finally. Therefore, when the drive circuit 10 drives the light-emitting element to emit light, the voltage of the control terminal of the drive circuit 10 can reach the sum of the data voltage and the stored threshold voltage, to enable that the current of the light-emitting element is not related to the threshold voltage of the drive circuit 10, so that the influence of the change of the threshold voltage of the drive circuit 10 on the driving current of the light-emitting element can be avoided, the light-emitting effect of the light-emitting element can be improve, and the service life of the light-emitting element can be prolonged.

Figure 3B:
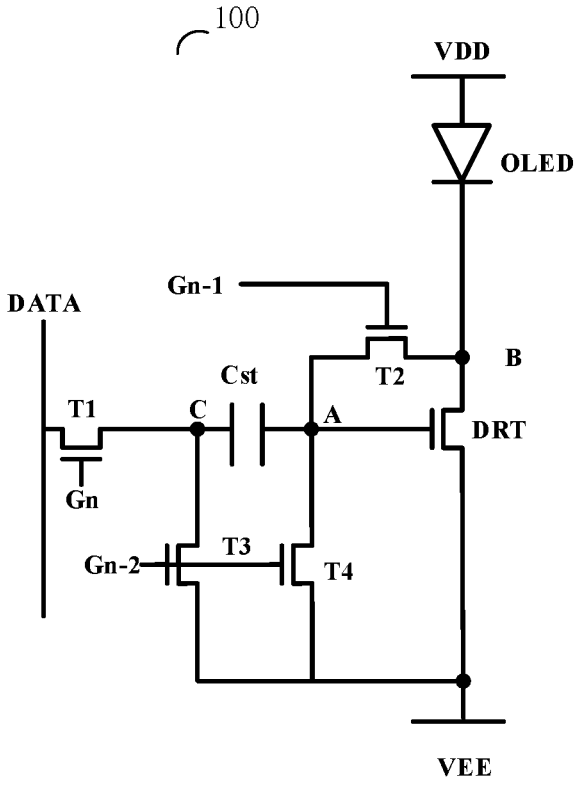
FIG. 3B is a circuit diagram showing another specific implementation example of the pixel circuit as shown in FIG. 2A.

Embodiments of the present disclosure include, but are not limited to, the configuration as shown in FIG. 3A. For example, as shown in FIG. 3B, in still another embodiment of the present disclosure, transistors in the pixel circuit 100 may also adopt N-type transistors, and the first electrode of each transistor may be the source electrode and the second electrode of each transistor may be the drain electrode. In the present embodiment, an anode of the light-emitting element in the pixel circuit 100 is connected to the first voltage terminal VDD to receive the first voltage. For example, in a display device, when the pixel circuits 100 as shown in FIG. 3B are arranged in an array, the anodes of the light-emitting elements can be electrically connected to a same voltage terminal (for example, a common voltage terminal), that is, using a common anode connection mode.

It should be noted that, in the embodiments of the present disclosure, in a case where the driving transistor DRT adopts an N-type transistor, the driving transistor DRT can be fabricated by using an IGZO (Indium Gallium Zinc Oxide) preparation process, and compared with the LTPS (Low Temperature Poly Silicon) preparation process, the size of the driving transistor can be effectively reduced and leakage current can be prevented.

Figure 3C:
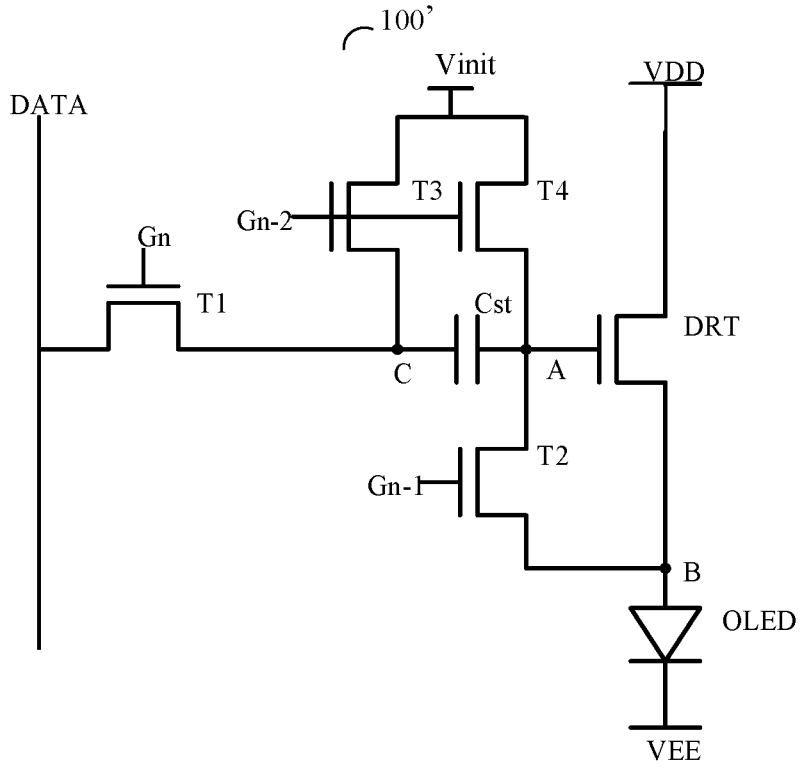
FIG. 3C is a circuit diagram showing a specific implementation example of the pixel circuit as shown in FIG. 2B.

The pixel circuit 100' as shown in FIG. 2B can be specifically implemented to the structure of pixel circuit as shown in FIG. 3C. As shown in FIG. 3C, the structure of the pixel circuit is similar to the structure of the pixel circuit as shown in FIG. 3A, and the difference includes that: the first electrode of the third transistor T3 and the first electrode of the fourth transistor T4 included in the discharge control circuit 30 are both connected to the initial voltage terminal Vinit.

For example, in the first phase, the initial voltage terminal Vinit provides a low level signal (e.g., the low level is 0V or a grounded voltage), the third control signal terminal Gn-2 inputs the third control signal to control the third transistor T3 and the fourth transistor T4 to be turned on, and to control the first electrode of the driving transistor DRT to discharge to the initial voltage terminal Vinit until the voltage difference between the first electrode and the gate electrode of the driving transistor DRT reaches the threshold voltage Vth.

It should be noted that other structures of the pixel circuit can be referred to the description in FIG. 3A, and details are not described here again.

It should be noted that the working principle of the pixel circuit as shown in FIG. 3B is similar to the working principle of the pixel circuit as shown in FIG. 3A, and the difference includes that: the first node A and the third node C in the pixel circuit as shown in FIG. 3A is discharged in the first phase, and the first node A and the third node C in the pixel circuit as shown in FIG. 3B is charged in the first phase. For example, in conjunction with FIG. 3B and FIG. 4, the first node A and the third node C are charged to the second voltage Vss and the second node B is charged to Vss-Vth in the first phase, so in the second phase, the voltage of the second node B with the threshold voltage Vth can be written to the first node A, and in the third phase, the data voltage Vdata can be written to the first node A by the coupling of the capacitors, and therefore, at this phase, the voltage of the first node A is Vdata+Vss−Vth.

Specifically, the value of the driving current $I_{OLED}$ flowing through the light-emitting element can be obtained according to the following formula:

$$I_{OLED}=\frac{1}{2}*K(Vgs-Vth)^2$$

When the voltage of the first terminal of the storage capacitor Cst is Vdata+Vss−Vth, that is, the voltage of the gate electrode (the first node A) of the driving transistor DRT is Vdata+Vss−Vth, the driving transistor DRT is turned on. At this time, the voltage of the first electrode (i.e., the source electrode) of the driving transistor is Vdd, and the Vdd is substituted into the above formula to obtain the following:

$$Vgs-Vth=V\text{data}+Vss-Vth-Vdd-Vth=V\text{data}+Vss-Vdd$$

It can be seen that when the light-emitting element emits light, the current I is related to the data voltage Vdata and the first voltage Vdd, and is no longer related to the threshold voltage Vth of the driving transistor DRT, so that the influence of the threshold voltage of the driving transistor on the driving current of the light-emitting element can be eliminated, the display effect of the light-emitting element can be improved, and the service life of the light-emitting element can be prolonged.

The working principle of the pixel circuit as shown in FIG. 3C is similar to the working principle of the pixel circuit as shown in FIG. 3A, and the difference only includes that: in the first phase, the first node A and the third node C are discharged through the initial voltage terminal Vinit. The repetitions will not be repeated here.

Figure 5A:
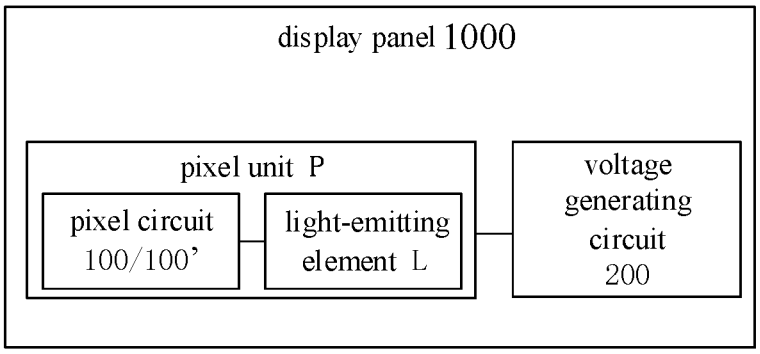
FIG. 5A is a schematic block diagram of a display panel according to an embodiment of the present disclosure.

An embodiment of the present disclosure further provides a display panel, which includes a plurality of pixel units arranged in an array. For example, each of the plurality of pixel units includes the pixel circuit 100 or the pixel circuit 100' provided in the above embodiments and a light-emitting element L. FIG. 5A is a schematic block diagram of a display panel according to an embodiment of the present disclosure.

As shown in FIG. 5A, a display panel 1000 of the embodiment of the present disclosure includes a plurality of pixel units P arranged in an array. For example, each of the plurality of pixel units P includes the pixel circuit 100/100' provided by the above-described embodiments of the present disclosure and the light-emitting element L, for example, the pixel circuit as shown in FIG. 3A, FIG. 3B, or FIG. 3C. The specific implementation of the pixel circuit can be referred to the foregoing embodiments of the pixel circuit 100. In order to avoid redundancy, details are not described here again.

For example, the display panel 1000 also includes a plurality of scan lines. For example, the plurality of scan lines are driven by a gate driving circuit (not shown in FIG. 5A).

For example, the plurality of pixel units are arranged in a plurality of rows, and a first control signal terminal Gn of a data writing circuit 50 of a pixel circuit 100 of a pixel unit in an nth (n is an integer greater than 3) row is connected to a scan line in the nth row, a storage control circuit 40 of the pixel circuit 100 of the pixel unit in the nth row is connected to a scan line in an (n−1)th row, and a discharge control circuit 30 of the pixel circuit 100 of the pixel unit in the nth row is connected to a scan line in an (n−2)th row. For example, the scan line in the (n−1)th row is further connected to a first control signal terminal Gn of a data writing circuit 50 of a pixel circuit 100 of a pixel unit in the (n−1)th row. For example, the scan line in the (n−2)th row is further connected to a first control signal terminal Gn of a data writing circuit 50 of a pixel circuit 100 of a pixel unit in the (n−2)th row. In this way, the layout space around the display panel is simplified, so the development of high-resolution display panels can be realized.

For example, the light-emitting element L may be an organic light emitting diode, a quantum dot light emitting diode or the like, and correspondingly, the display panel may be an OLED display panel, a QLED display panel or the like. In the following, the OLED may be taken as an example for description, and the corresponding description can also apply to the QLED.

As shown in FIG. 5A, the display panel 1000 further includes a voltage generating circuit 200. For example, the voltage generating circuit 200 is connected to the pixel circuit 100/100' in the pixel unit P, and for example, is located in a power management integrated circuit in a module driving circuit system. For example, the voltage generating circuit 200 is connected to the first voltage terminal VDD and/or the second voltage terminal VEE of the pixel circuit 100/100', and is configured to correspondingly change a value of a first voltage provided by the first voltage terminal VDD and/or a value of a second voltage provided by the second voltage terminal VEE.

For example, in the first phase, the voltage generating circuit 200 changes the first voltage and/or the second voltage, and for example, controls the first voltage to be at a low level and the second voltage to be at a high level, to control the second terminal 120 of the drive circuit 10 to discharge to the first voltage terminal VDD; and in the third phase, the voltage generating circuit 200 changes the first voltage and the second voltage again, and for example, controls the first voltage to be at a high level and controls the second voltage to be at a low level, to enable the drive circuit 10 to be turned on to drive the light-emitting element to start emitting light. The following embodiments are the same as those described here and will not be described again.

Figure 5B:
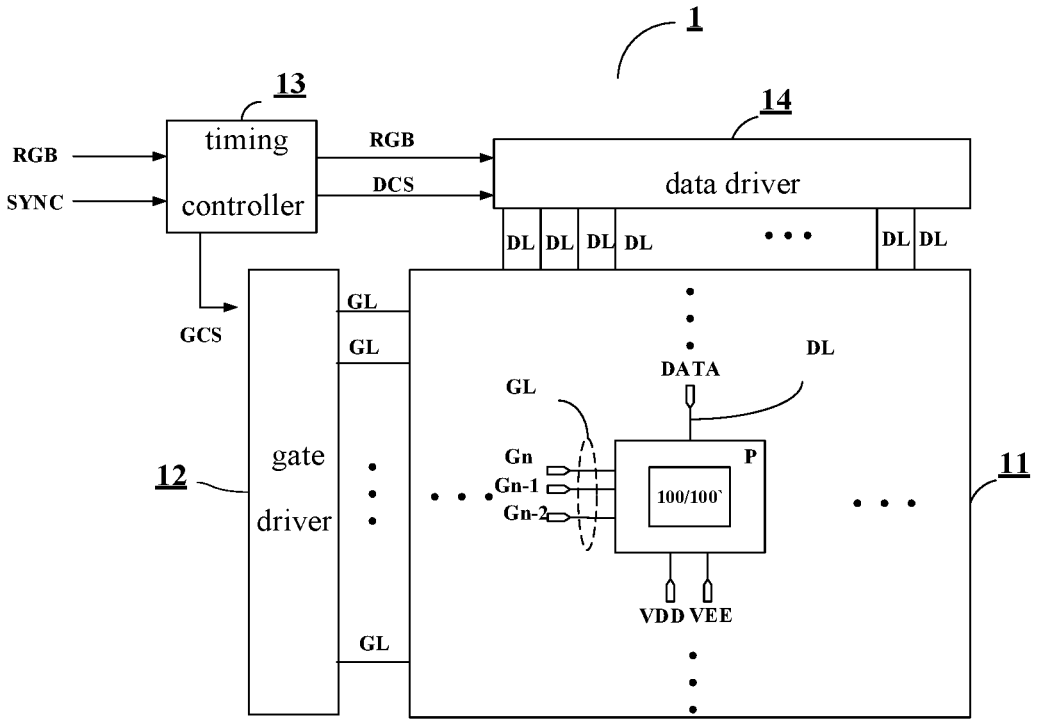
FIG. 5B is a schematic diagram of another display panel according to an embodiment of the present disclosure.

FIG. 5B is a schematic block diagram of another display panel according to an embodiment of the present disclosure. As shown in FIG. 5B, a display panel 11 is in a display device 1 and is electrically connected to a gate driver 12, a timing controller 13, and a data driver 14. The display panel 11 includes a plurality of pixel units P defined according to a plurality of scan lines GL and a plurality of data lines DL; the gate driver 12 is used to drive the plurality of scan lines GL; the data driver 14 is used to drive the plurality of data lines DL; and the timing controller 13 is used for processing the image data RGB input from an outside of the display device 1, supplying the processed image data RGB to the data driver 14, and outputting a scan control signal GCS and a data control signal DCS to the gate driver 12 and the data driver 14, to control the gate driver 12 and the data driver 14.

For example, the display panel 11 includes the plurality of pixel units P, which includes any one of the pixel circuits 100 or pixel circuits 100' provided in the above embodiments. For example, the pixel unit P includes any one of the pixel circuits as shown in FIGS. 3A-3C. As shown in FIG. 5B, the display panel 11 further includes the plurality of scan lines GL and the plurality of data lines DL. For example, the plurality of scan lines are correspondingly connected to data writing circuits 50, storage control circuits 30, and discharge control circuits 40 in pixel circuits 100 or in pixel circuits 100' of the pixel units in each row, to provide the first control signal, the second control signal, and the third control signal, respectively. The connection manner of the plurality of scan lines can be referred to the related description of the example as shown in FIG. 5A, and details are not described here again.

For example, the pixel unit P is located at an intersection area of the scan lines GL and the data lines DL. For example, as shown in FIG. 5B, each pixel unit P is connected to three scan lines GL (for providing the first control signal, the second control signal, and the third control signal, respectively), a data line DL, a first voltage line for supplying the first voltage, a second voltage line for supplying the second voltage, or an initial voltage line (not shown in FIG. 5B) for supplying the initial voltage. For example, the first voltage line or the second voltage line can be replaced with a corresponding common electrode (for example, a common anode or a common cathode). It should be noted that only a part of the pixel units P, the scan lines GL, and the data lines DL are shown in FIG. 5B. It should be noted that the following embodiments are the same as the above description, and are not described again.

For example, the plurality of pixel units P are arranged in a plurality of rows, and first control signal terminals Gn of the data writing circuits 50 of the pixel units P in each row are connected to the same scan line GL. The storage control circuits 30 and the discharge control circuits 40 of the pixel circuits of the pixel units P in each row are respectively connected to the other two scan lines GL to receive the first control signal and the second control signal. For example, the data line DL in each column is connected to the data writing circuits 50 of the pixel circuits 10 in the column to provide the data voltage.

For example, the gate driver 12 supplies a plurality of strobe signals to the plurality of scan lines GL according to the plurality of scan control signals GCS from the timing controller 13. The plurality of strobe signals include the first control signal, the second control signal, and the third control signal. These signals are supplied to each pixel unit P through the plurality of scan lines GL.

For example, the data driver 14 converts the digital image data RGB input from the timing controller 13 into data signals according to the plurality of data control signals DCS from the timing controller 13 by using the reference gamma voltage. The data driver 14 supplies the converted data signals to the plurality of data lines DL.

For example, the timing controller 13 processes image data RGB input from the outside of the display device to match the size and resolution of the display panel 11, and then supplies the processed image data to the data driver 14. The timing controller 13 generates the plurality of scan control signals GCS and the plurality of data control signals DCS by using synchronization signals (for example, a dot clock DCLK, a data enable signal DE, a horizontal synchronization signal Hsync, and a vertical synchronization signal Vsync) input from the outside of the display device. The timing controller 13 supplies the generated scan control signals GCS and data control signals DCS to the gate driver 12 and the data driver 14, respectively, for controlling the gate driver 12 and the data driver 14.

For example, the data driver 14 may be connected to the plurality of data lines DL to provide the data voltage Vdata. Also, the data driver 14 may be connected to the plurality of first voltage lines, the plurality of second voltage lines, and/or the plurality of initial voltage lines to provide the first voltage, the second voltage, and/or the initial voltage, respectively.

For example, the gate driver 12 and the data driver 14 can be implemented as a semiconductor chip. The display device 1 may also include other components, such as signal decoding circuits, voltage conversion circuits, etc., which may adopt, for example, conventional components, and will not be described in detail here.

For example, the display panel 1000 or the display panel 11 provided by this embodiment can be applied to any product or component, which has a display function, such as an electronic paper, a mobile phone, a tablet computer, a television, a display, a laptop, a digital photo frame, a navigator, a virtual reality display device and the like.

It should be noted that not all the constituent elements of the display panel 1000 or the display panel 11 are given for clarity and conciseness. In order to realize the necessary functions of the display panel, those skilled in the art can provide and set other constituent units not shown according to specific needs, which is not limited in the embodiments of the present disclosure.

The display panel provided by the embodiments of the present disclosure has a good display effect and a long lifetime, and thus has high display performance.

Figure 6:
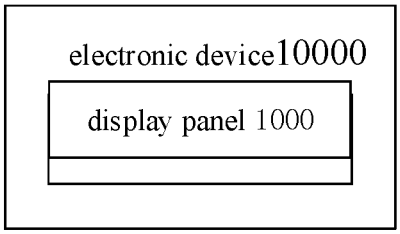
FIG. 6 is a schematic block diagram of an electronic device according to an embodiment of the present disclosure.

An embodiment of the present disclosure also provides an electronic device. FIG. 6 is a schematic block diagram of an electronic device according to an embodiment of the present disclosure.

As shown in FIG. 6, an electronic device 10000 of the embodiment of the present disclosure includes the display panel 1000 provided by the above-described embodiments of the present disclosure. For example, the electronic device 10000 includes the display panel 1000 as illustrated in FIG. 5A or the display panel 11 as illustrated in FIG. 5B. The specific implementation of the electronic device 10000 may be referred to the embodiments of the foregoing display panels. In order to avoid redundancy, details are not described here again.

For example, the electronic device 10000 provided in this embodiment may be any product or component, which has a display function, such as a mobile phone, a tablet computer, a television, a display, a notebook computer, a digital photo frame, a navigator, a virtual reality device and the like.

It should be noted that not all the constituent elements of the electronic device 10000 are given for clarity and conciseness. In order to realize the necessary functions of the electronic device, those skilled in the art can provide and set other component units not shown according to specific needs, which is not limited in the embodiments of the present disclosure.

The electronic device provided by the embodiments of the present disclosure has a good display effect and a long lifetime, and thus the electronic device has high performance.

Figure 7:
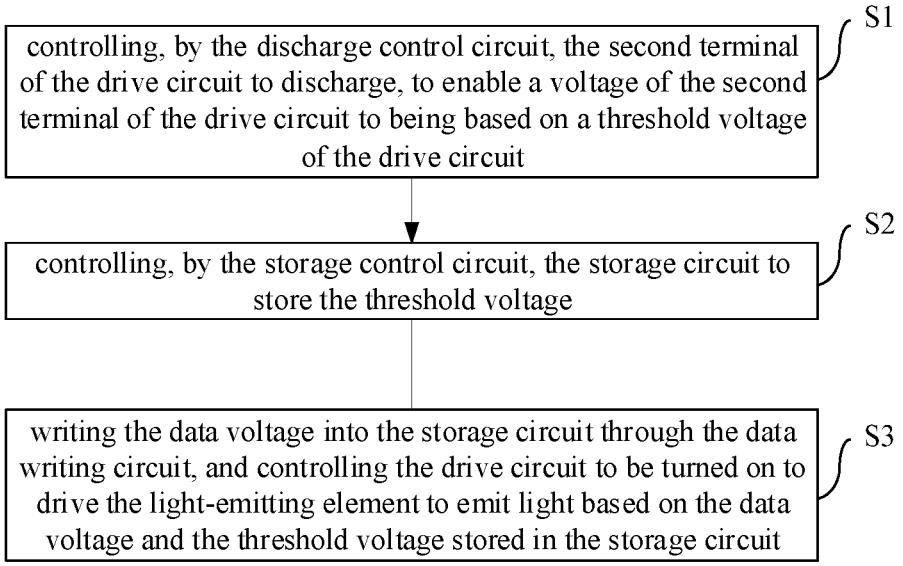
FIG. 7 is a flowchart of a method for driving a pixel circuit according to an embodiment of the present disclosure.

Embodiments of the present disclosure also provide a method for driving a pixel circuit, which can be used to drive the pixel circuit provided by any embodiment of the present disclosure. FIG. 7 is a flowchart of a method for driving a pixel circuit according to an embodiment of the present disclosure. In the following, the method for driving the pixel circuit as shown in FIG. 3A will be taken as an example for description. For example, in the example of the pixel circuit 100 as shown in FIG. 3A, the method includes steps S1-S3.

Step S1: controlling, by the discharge control circuit, the second terminal of the drive circuit to discharge, to enable a voltage of the second terminal of the drive circuit to being based on a threshold voltage of the drive circuit.

Step S2: controlling, by the storage control circuit, the storage circuit to store the threshold voltage.

Step S3: writing the data voltage into the storage circuit through the data writing circuit, and controlling the drive circuit to be turned on to drive the light-emitting element to emit light based on the data voltage and the threshold voltage stored in the storage circuit.

Referring to FIG. 2A and FIG. 3A, the drive circuit 10 includes a driving transistor DRT. A control electrode (i.e., a gate electrode) of the driving transistor DRT is connected to the storage circuit 20, a first electrode of the driving transistor DRT is connected to the first terminal of the light-emitting element, and a second electrode of the driving transistor DRT is connected to the first voltage terminal VDD. The second terminal of the light-emitting element is connected to the second voltage terminal VEE.

The data writing circuit 50 includes a first transistor T1. A control electrode of the first transistor T1 is connected to the first control signal terminal Gn, a first electrode of the first transistor T1 is connected to the storage circuit 20, and a second electrode of the first transistor T1 is connected to the data signal input terminal DATA.

The storage circuit 20 includes a storage capacitor Cst. A first terminal of the storage capacitor Cst is connected to the control electrode of the driving transistor T1, and a second terminal of the storage capacitor Cst is connected to the first electrode of the first transistor T1.

The storage control circuit 40 includes a second transistor T2. A control electrode of the second transistor T2 is connected to a second control signal terminal Gn-1, a first electrode of the second transistor T2 is connected to the first electrode of the driving transistor DRT, and a second electrode of the second transistor T2 is connected to the first terminal of the storage capacitor Cst.

The discharge control circuit 30 includes a third transistor T3 and a fourth transistor T4. A control electrode of the third transistor T3 is connected to a third control signal terminal Gn-2, a first electrode of the third transistor T3 is connected to the first voltage terminal VDD, and a second electrode of the third transistor T3 is connected to the second terminal of the storage capacitor Cst. A control electrode of the fourth transistor T4 is connected to the third control signal terminal Gn-2, a first electrode of the fourth transistor T4 is connected to the first voltage terminal VDD, and a second electrode of the fourth transistor T4 is connected to the first terminal of the storage capacitor Cst.

In the method for driving the pixel circuit of at least one embodiment of the present disclosure, each light emitting period of the light-emitting element includes three phases.

In the first phase, the discharge control circuit 40 is controlled to be turned on, and the second terminal 120 of the drive circuit 10 is controlled to discharge to the first voltage terminal VDD until the voltage of the second terminal of the drive circuit 10 reaches the threshold voltage.

In the second phase, the storage control circuit 30 is controlled to be turned on to store the threshold voltage in the storage circuit 20.

In the third phase, the first control signal terminal inputs a first control signal to control the data writing circuit 50 to be turned on, and a voltage of the first terminal of the storage circuit 20 is coupled to a sum of the data voltage and the threshold voltage, to turn on the drive circuit 10 to drive the light-emitting element to emit light.

For example, in an example, the method further includes that: in the first phase, the first voltage is changed to control the second terminal 120 of the drive circuit 10 to discharge to the first voltage terminal VDD; and in the third phase, the first voltage is changed again to enable the drive circuit to be turned on to drive the light-emitting element to emit light.

For example, in another example, the second terminal of the light-emitting element is connected to the second voltage terminal to receive the second voltage, and the method further includes that: in the first phase, the first voltage and the second voltage are changed to control the second terminal 120 of the drive circuit 10 to discharge to the first voltage terminal VDD (for example, when the driving transistor is implemented as an N-type transistor, to charge); and in the third phase, the first voltage and the second voltage are changed again to enable the drive circuit 10 to be turned on to drive the light-emitting element L to emit light.

For example, in the first phase and the second phase, the first voltage is changed from a high level to a low level, and the second voltage is changed from a low level to a high level; and in the third phase, the first voltage is changed from the low level during the first phase and the second phase to a high level, and the second voltage is changed from the high level during the first phase and the second phase to a low level.

More specifically, in the first phase, the third control signal input by the third control signal terminal Gn-2 controls the third transistor T3 and the fourth transistor T4 to be turned on, and the first electrode of the driving transistor DRT is controlled to discharge to the first voltage terminal VDD until the voltage at the second terminal of the drive circuit 10 reaches the threshold voltage, or until the voltage difference between the first electrode and the gate electrode of the driving transistor DRT reaches the threshold voltage Vth. For example, in a case where the first voltage supplied by the first voltage terminal VDD becomes 0, the voltage of the first electrode of the driving transistor DRT reaches the threshold voltage Vth, and the data voltage input by the data signal input terminal is Vdata; and for example, in a case where the first voltage supplied by the first voltage terminal VDD is not 0 (for example, δ), the voltage of the first electrode of the driving transistor DRT reaches the threshold voltage Vth+δ, and the data voltage input by the data signal input terminal is Vdata−δ at this time, so the voltage of the gate electrode of the driving transistor can be ensured to be Vdata+Vth. It should be noted that the following embodiments are the same as the above description, and are not described again.

In the second phase, the second control signal input by the second control signal terminal Gn-1 controls the second transistor T2 to be turned on, and the threshold voltage Vth is stored in the storage capacitor Cst.

In the third phase, the first control signal input by the first control signal terminal Gn controls the first transistor T1 to be turned on, a voltage of the first terminal of the storage capacitor Cst is coupled to a sum of the data voltage and the threshold voltage, i.e., Vdata+Vth, to turn on the driving transistor DRT, to drive the light-emitting element to start to emit light.

It should be noted that the transistors used in the embodiments of the present disclosure may be thin film transistors, field effect transistors or other switching devices having the like characteristics. The thin film transistors are taken as an example for description in the embodiments of the present disclosure. The source electrode and the drain electrode of a transistor used here may be symmetrical in structural, so the source electrode and the drain electrode of the transistor may be indistinguishable in structural. In the embodiments of the present disclosure, in order to distinguish two electrodes of the transistor except the gate electrode, one of the two electrodes is described as a first electrode directly, and the other electrode is described as a second electrode.

For example, a signal timing as shown in FIG. 4 can be respectively provided by the first voltage terminal VDD, the second voltage terminal VEE, the first control signal terminal Gn, the second control signal terminal Gn-1, the third control signal terminal Gn-2, and the data signal input terminal DATA, to control the light-emitting element to emit light.

For example, in conjunction with FIG. 3A and FIG. 4, in the first phase, that is, in a period t1, the third control signal terminal Gn-2 inputs a high level signal, the third transistor T3 and the fourth transistor T4 are turned on, the first voltage input by the first voltage terminal VDD changes from a high level to a low level, and the second voltage input by the second voltage terminal VEE changes from a low level to a high level. During this phase, the first node A and the third node C are connected to the first voltage terminal VDD to become a low level, and the second electrode (for example, the drain electrode) of the driving transistor DRT is connected to the gate electrode of the driving transistor DRT, and the driving transistor DRT becomes a diode structure. Because the first electrode (for example, the source electrode) of the driving transistor DRT is at a high level during the previous light-emitting period, the first electrode of the driving transistor DRT discharges to the first voltage terminal VDD until the voltage difference between the first electrode and the gate electrode of the driving transistor DRT reaches the threshold voltage of the driving transistor DRT, and for example, in a case where the first voltage supplied by the first voltage terminal VDD is 0V, the voltage of the second node B reaches the threshold voltage Vth.

In the second phase, that is, in a period t2, the second control signal terminal Gn-1 inputs a high level signal, the second transistor T2 is turned on, to enable the second node B to be electrically connected to the first node A, and the threshold voltage Vth is stored into the first terminal of the storage capacitor Cst, that is, the first node A.

In the third phase, that is, in a period t3, the first control signal terminal Gn inputs a high level signal, and the first transistor T1 is turned on, the first voltage Vdd input from the first voltage terminal VDD changes from a low level to a high level, and the second voltage input from the second voltage terminal VEE changes from a high level to a low level. The second terminal of the storage capacitor Cst is written with the data voltage Vdata, and the voltage of the first terminal of the storage capacitor Cst is coupled to the sum of the data voltage and the threshold voltage, i.e., Vdata+Vth, that is, the voltage of the first node A is Vdata+Vth, to turn on the driving transistor DRT, to drive the light-emitting element to start to emit light. During this phase, the first voltage Vdd charges the second node B through the driving transistor DRT, and the voltage of the second node B is charged to the first voltage Vdd.

Specifically, the value of the driving current $I_{OLED}$ flowing through the light emitting-element can be obtained according to the following formula:

$$I_{OLED}=\frac{1}{2}*K(Vgs-Vth)^2$$

where K is a constant, and Vgs is the voltage between the gate electrode and the source electrode of the driving transistor DRT, that is, the voltage between the first node A and the second node B.

When the voltage of the first terminal of the storage capacitor Cst is Vdata+Vth, that is, the voltage of the gate electrode (the first node A) of the driving transistor DRT is Vdata+Vth, the driving transistor DRT is turned on, and the Vgs is substituted into the above formula to obtain Vgs−Vth as following:

$$Vgs-Vth=V\text{data}+Vth-Vdd-Vth=V\text{data}-Vdd$$

It can be seen that when the light-emitting element emits light, the current I is related to the data voltage Vdata and the first voltage Vdd, and is no longer related to the threshold voltage Vth of the driving transistor DRT.

The method for driving the pixel circuit according to the embodiments of the present disclosure can control the drive circuit to discharge through the discharge control circuit connected to the storage circuit, and can control the storage circuit to store the voltage after the drive circuit discharges through the storage control circuit connected to the drive circuit, and the drive circuit can be turned on by the data voltage and the voltage stored in the storage circuit when the data writing circuit writes the data voltage finally. Therefore, when the drive circuit drives the light-emitting element to emit light, the voltage of the control terminal of the drive circuit can reach the sum of the data voltage and the stored threshold voltage, to enable that the current of the light-emitting element is not related to the threshold voltage of the drive circuit, so that the influence of the change of the threshold voltage of the drive circuit on the driving current of the light-emitting element can be avoided, the light-emitting effect of the light-emitting element can be improve, and the service life of the light-emitting element can be prolonged.

In the description of the present specification, the description of the referenced terms: "one embodiment", "some embodiments", "example", "specific example", "some examples" and the like, means that a particular feature, structure, material or characteristic described in connection with the embodiment or example is included in at least one embodiment or example of the present disclosure. In the present specification, the schematic representation of the above terms is not necessarily directed to the same embodiment or example. Furthermore, the particular features, structures, materials, or characteristics described may be combined in a suitable manner in any one or more embodiments or examples. In addition, in a case of no contradiction, various embodiments or examples and features of the various embodiments or examples described in the specification may be combined.

Although the embodiments of the present disclosure have been shown and described above, it is understood that the foregoing embodiments are illustrative and are not to be construed as limitations, and variations, modifications, alterations and variations of the above-described embodiments may be made by those skilled in the art within the scope of the present disclosure.

The above description merely is an exemplary embodiment of the present disclosure, and not intended to limit the scope of the disclosure, and the scope of the disclosure is determined by the scope defined by the claims.

What is claimed is:

1. A pixel circuit, comprising a drive circuit, a storage circuit, a discharge control circuit, a storage control circuit, and a data writing circuit; wherein, the drive circuit comprises a control terminal, a first terminal and a second terminal, and is configured to control a driving current for driving a light-emitting element to emit light, and the first terminal of the drive circuit is configured to receive a first voltage from a first voltage terminal;

the storage circuit is connected to the control terminal of the drive circuit;

the discharge control circuit is connected to the storage circuit and the control terminal of the drive circuit, and is configured to control a voltage across the storage circuit and to control the second terminal of the drive circuit to discharge;

the storage control circuit is connected to the control terminal of the drive circuit, the second terminal of the drive circuit, and the storage circuit, and is configured to control the storage circuit to store a voltage of the second terminal of the drive circuit; and the data writing circuit is connected to the storage circuit, a data signal input terminal, a first control signal terminal, and the discharge control circuit, and is configured to write a data voltage supplied from the data signal input terminal into the storage circuit to store the data voltage in the storage circuit in response to a first control signal input by the first control signal terminal, to control the drive circuit to be turned on to drive the light-emitting element to emit light, wherein the second terminal of the drive circuit is directly connected to a first terminal of the light-emitting element, the storage control circuit is directly connected to the light-emitting element, wherein a second terminal of the light-emitting element is connected to a second voltage terminal to receive a second voltage, wherein the discharge control circuit comprises a third transistor and a fourth transistor;

a control electrode of the third transistor is connected to a third control signal terminal to receive a third control signal, a first electrode of the third transistor is connected to the first voltage terminal or an initial voltage terminal, and a second electrode of the third transistor is connected to the second terminal of the storage capacitor; and a control electrode of the fourth transistor is connected to the third control signal terminal to receive the third control signal, a first electrode of the fourth transistor is connected to the first voltage terminal or the initial voltage terminal, and a second electrode of the fourth transistor is connected to the first terminal of the storage capacitor, the first electrode of the third transistor and the first electrode of the fourth transistor and the first terminal of the drive circuit are all directly connected to a same voltage terminal together, wherein each light-emitting period of the light-emitting element comprises a first phase, a second phase and a third phase, in the first phase and the second phase, the first voltage is changed from a high level to a low level, and the second voltage is changed from a low level to a high level; in the second phase, the first voltage is kept at a low level, and the second voltage is kept at a high level; and in the third phase, the first voltage is changed from the low level to a high level, and the second voltage is changed from the high level to a low level.

2. The pixel circuit according to claim 1, wherein the drive circuit comprises a driving transistor; and a control electrode of the driving transistor is connected to the storage circuit, a first electrode of the driving transistor is connected to a first terminal of the light-emitting element, a second electrode of the driving transistor is connected to the first voltage terminal.

3. The pixel circuit according to claim 2, wherein the data writing circuit comprises a first transistor; and a control electrode of the first transistor is connected to the first control signal terminal to receive the first control signal, a first electrode of the first transistor is connected to the storage circuit, and a second electrode of the first transistor is connected to the data signal input terminal to receive the data voltage.

4. The pixel circuit according to claim 3, wherein the storage circuit comprises a storage capacitor; and a first terminal of the storage capacitor is connected to the control electrode of the driving transistor, and a second terminal of the storage capacitor is connected to the first electrode of the first transistor.

5. The pixel circuit according to claim 4, wherein the storage control circuit comprises a second transistor; and a control electrode of the second transistor is connected to a second control signal terminal to receive a second control signal, a first electrode of the second transistor is connected to the first electrode of the driving transistor, and a second electrode of the second transistor is connected to the first terminal of the storage capacitor.

6. A display panel, comprising a plurality of pixel units arranged in an array, wherein each of the plurality of pixel units comprises the pixel circuit according to claim 3 and a light-emitting element.

7. A display panel, comprising a plurality of pixel units arranged in an array, wherein each of the plurality of pixel units comprises the pixel circuit according to claim 2 and a light-emitting element.

8. A display panel, comprising a plurality of pixel units arranged in an array, wherein each of the plurality of pixel units comprises the pixel circuit according to claim 1 and a light-emitting element.

9. The display panel according to claim 8, further comprising a plurality of scan lines, wherein the plurality of pixel units are arranged in a plurality of rows, a first control signal terminal of a data writing circuit of a pixel circuit of a pixel unit in an nth row is connected to a scan line in the nth row, a storage control circuit of the pixel circuit of the pixel unit in the nth row is connected to a scan line in an (n-1)th row, and a discharge control circuit of the pixel circuit of the pixel unit in the nth row is connected to a scan line in an (n-2)th row;

the scan line in the (n-1)th row is further connected to a first control signal terminal of a data writing circuit of a pixel circuit of a pixel unit in the (n-1)th row;

the scan line in the (n-2)th row is further connected to a first control signal terminal of a data writing circuit of a pixel circuit of a pixel unit in the (n-2)th row; and n is an integer greater than 3.

10. The display panel according to claim 9, wherein the light-emitting element is an organic light-emitting diode.

11. An electronic device, comprising the display panel according to claim 10.

12. The display panel according to claim 9, further comprising a voltage generating circuit, wherein the voltage generating circuit is connected to the first voltage terminal and/or a second voltage terminal, and is configured to correspondingly change a value of the first voltage provided by the first voltage terminal and/or a value of a second voltage provided by the second voltage terminal.

13. An electronic device, comprising the display panel according to claim 12.

14. An electronic device, comprising the display panel according to claim 9.

15. An electronic device, comprising the display panel according to claim 8.

16. A method for driving the pixel circuit according to claim 1, comprising:

controlling, by the discharge control circuit, the second terminal of the drive circuit to discharge, to enable a voltage of the second terminal of the drive circuit to being based on a threshold voltage of the drive circuit;

controlling, by the storage control circuit, the storage circuit to store the threshold voltage; and writing the data voltage into the storage circuit through the data writing circuit, and controlling the drive circuit to be turned on to drive the light-emitting element to emit light based on the data voltage and the threshold voltage stored in the storage circuit.

17. The method for driving the pixel circuit according to claim 16, wherein each light-emitting period of the light-emitting element comprises three phases, and the method comprises:

in a first phase, controlling the discharge control circuit to be turned on, and controlling the second terminal of the drive circuit to discharge to the first voltage terminal until the voltage of the second terminal of the drive circuit reaches the threshold voltage;

in a second phase, controlling the storage control circuit to be turned on, and storing the threshold voltage in the storage circuit; and in a third phase, inputting, through the first control signal terminal, the first control signal to control the data writing circuit to be turned on, a voltage of a first terminal of a storage capacitor coupling as a sum of the data voltage and the threshold voltage, to turn on the drive circuit to drive the light-emitting element to emit light.

18. The method for driving the pixel circuit according to claim 17, further comprising:

in the first phase, changing the first voltage to control the second terminal of the drive circuit to discharge to the first voltage terminal; and in the third phase, changing the first voltage again to enable the drive circuit to be turned on to drive the light-emitting element to emit light.

19. The method for driving the pixel circuit according to claim 17, wherein a second terminal of the light-emitting element is connected to a second voltage terminal to receive a second voltage, and the method further comprises:

in the first phase, changing the first voltage and the second voltage to control the second terminal of the drive circuit to discharge to the first voltage terminal; and in the third phase, changing the first voltage and the second voltage again to enable the drive circuit to be turned on to drive the light-emitting element to emit light.

20. The pixel circuit according to claim 1, wherein a terminal of the storage circuit is connected to the first voltage terminal only via the third transistor, so that the first voltage is directly applied to the storage circuit.

* * * * *